US006782215B2

(12) United States Patent
Komori

(10) Patent No.: US 6,782,215 B2
(45) Date of Patent: Aug. 24, 2004

(54) ELECTROPHOTOGRAPHIC PRINTER

(75) Inventor: Chihiro Komori, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/268,085

(22) Filed: Oct. 10, 2002

(65) Prior Publication Data

US 2003/0091358 A1 May 15, 2003

(30) Foreign Application Priority Data

Oct. 10, 2001 (JP) ..... 2001-313134

(51) Int. Cl.[7] ..... G03G 15/02; G03G 15/16
(52) U.S. Cl. ..... 399/50; 399/66
(58) Field of Search ..... 399/46, 48, 50, 399/66, 168, 174, 176, 297, 307, 310, 313

(56) References Cited

U.S. PATENT DOCUMENTS 5,151,736 A * 9/1992 Ohzeki et al. ..... 399/66
5,717,979 A * 2/1998 Senba et al. ..... 399/50
5,737,663 A * 4/1998 Handa et al. ..... 399/50
5,771,422 A * 6/1998 Morihara ..... 399/50
5,812,905 A * 9/1998 Yoo ..... 399/50
5,893,659 A * 4/1999 Nanjo et al. ..... 399/48
6,185,387 B1 * 2/2001 Ohzeki et al. ..... 399/66
6,212,352 B1 * 4/2001 Kagawa et al. ..... 399/307
6,253,038 B1 * 6/2001 Ito et al. ..... 399/50
6,385,409 B2 * 5/2002 Suzuki et al. ..... 399/66

* cited by examiner

*Primary Examiner*—Sandra L. Brase
(74) *Attorney, Agent, or Firm*—Staas & Halsey LLP

(57) ABSTRACT

An electrophotographic printer maintains a surface potential of a photosensitive drum at a constant value even when a photosensitive layer corresponding to a surface of the photosensitive drum wears down. The electrophotographic printer includes a charging power supply 3, a charging roller 1, a photosensitive drum 2, a discharge unit 11, a charging current detection unit 4, a transfer power supply 9, a transfer roller 8, a transfer current detection unit 14, an arithmetic and control unit 12, and a memory unit 13. The arithmetic and control unit controls the photosensitive drum to make a plurality of revolutions in a state when the discharge unit is turned off in an initial operation of the electrophotographic printer, controls the charging power supply to generate a charging voltage to obtain a charging current as the surface potential −Vsf of the photosensitive drum, obtains a transfer current detected by the transfer current detection unit, calculates the charging current needed in obtaining the obtained transfer current in a state when the discharge unit is turned on, and stores the calculated charging voltage in the memory unit, and in a real printing procedure, the arithmetic and control unit rotates the photosensitive drum in the state where the discharge unit is turned on, and equalizes the charging voltage output from the charge power supply to a value stored in the memory unit.

22 Claims, 4 Drawing Sheets

FIG. 1 (PRIOR ART)

SURFACE POTENTIAL WHEN CHARGED VOLTAGE IS 1350V

| ROLLER | | | DRUM | WEAR | | | |
|---|---|---|---|---|---|---|---|
| ENVIRONMENT | TIME | EXPECTATION ROLLER | | MARK | | | END OF LIFE SPAN |
| | | RESISTANCE(Ω) | EXPECTED THICKNESS(μm) | 30 | 25 | 20 | 15 |
| N/N | EARLY TIME | 3*E6 | CHARGED CURRENT(μA) | 16.0 | 19.9 | 25.5 | 34.6 |
| | | | DRUM SURFACE POTENTIAL(V) | 701.9 | 725.3 | 743.5 | 756.3 |
| N/N | END OF LIFE SPAN | 6*E6 | CHARGED CURRENT(μA) | 15.1 | 18.5 | 23.3 | 30.9 |
| | | | DRUM SURFACE POTENTIAL(V) | 659.5 | 674.1 | 680.1 | 674.9 |
| L/L | EARLY TIME | 1*E7 | CHARGED CURRENT(μA) | 14.0 | 16.9 | 20.9 | 27.0 |
| | | | DRUM SURFACE POTENTIAL(V) | 610.5 | 616.0 | 610.7 | 590.2 |
| L/L | END OF LIFE SPAN | 2*E7 | CHARGED CURRENT(μA) | 11.8 | 13.9 | 16.7 | 20.5 |
| | | | DRUM SURFACE POTENTIAL(V) | 514.7 | 506.9 | 486.5 | 449.3 |

ELECTROPHOTOGRAPHIC PRINTER

CROSS-REFERENCE TO RELATED APPLICATIONS

This application claims the benefit of Japanese Patent Application No. 2001-313134, filed Oct. 10, 2001, in the Japanese Patent Office, the disclosure of which is incorporated herein by reference.

BACKGROUND OF THE INVENTION

1. Field of the Invention

The present invention relates to an electrophotographic printer, and more particularly, to an apparatus for charging a photosensitive drum in an electrophotographic printer during an initial printing process.

2. Description of the Related Art

A printing procedure of an electrophotographic printer includes charging a surface of a photosensitive drum. In order to improve a quality of a picture printed after the charging of the photosensitive drum, a surface potential of the photosensitive drum needs to be maintained at a predetermined value.

In order to maintain the surface potential of the photosensitive drum at a constant value, a surface potential sensor measuring the surface potential of the photosensitive drum is provided so that an amount of an electrical charge transmitted to the surface of the photosensitive drum can be controlled according to a result of detection of the surface potential sensor. Since the surface potential sensor is usually expensive, the surface potential sensor can be used in only high-grade types of machines.

Accordingly, in the prior art, a charging current used to charge the surface of the photosensitive drum is controlled to maintain the constant value. By controlling the charging current, even when a resistance of a charging roller transmitting the charging current, that is, the electrical charge, toward the surface of the photosensitive drum varies according to a temperature or humidity, the surface potential of the photosensitive drum can be maintained at the constant value.

However, as shown in FIG. 1, if a photosensitive layer corresponding to the surface of the photosensitive drum wears down, a thickness of the photosensitive layer is reduced, and an electrostatic capacity of the photosensitive layer increases. In this case, if the charging current is maintained at the constant value, the surface potential of the photosensitive drum is reduced and thus cannot be maintained at the constant value.

SUMMARY OF THE INVENTION

To solve the above and other problems, it is an object of the present invention to provide an electrophotographic printer which can maintain a surface potential of a photosensitive drum at a constant value even when a photosensitive layer corresponding to a surface of the photosensitive drum wears down.

Additional objects and advantageous of the invention will be set forth in part in the description which follows and, in part, will be obvious from the description, or may be learned by practice of the invention.

Accordingly, to achieve the above and other objects, there is provided an electrophotographic printer. The electrophotographic printer includes a charging power supply which generates a variable charging voltage, a charging roller to which the charging voltage generated by the charging power supply is supplied, a photosensitive drum charged by the charging roller, a discharge unit which discharges the charged photosensitive drum, a charging current detection unit which detects a charge value of the charging current flowing between the charging power supply and the charging roller, a transfer power supply which generates a predetermined transfer voltage, a transfer roller to which the transfer voltage generated by the transfer power supply is supplied, a transfer current detection unit which detects a transfer value of transfer current flowing between the transfer power supply and the transfer roller, an arithmetic and control unit which controls the charging voltage generated by the charging power supply, on and off of a rotation of the photosensitive drum, and on and off of the discharge unit and inputs the charging value of the charging current detected by the charging current detection unit and the transfer value of the transfer current detected by the transfer current detection unit, and a memory unit connected to the arithmetic and control unit.

The arithmetic and control unit controls the photosensitive drum to make a plurality of revolutions in a state when the discharge unit is turned off in an initial operation of the electrophotographic printer, controls the charging power supply to generate the charging voltage to obtain the charging current as the surface potential of the photosensitive drum, obtains the transfer current detected by the transfer current detection unit, calculates the charging current needed in obtaining the obtained transfer current in a state when the discharge unit is turned on, and stores the calculated charging voltage in the memory unit, and in an real printing procedure, the arithmetic and control unit rotates the photosensitive drum in a state when the discharge unit is turned on, and equalizes the charging voltage output from the charging power supply to the charge value stored in the memory unit.

According to an aspect of the present invention, the arithmetic and control unit controls the photosensitive drum to make a plurality of revolutions in a state when the discharge unit is turned off in an initial operation of the electrophotographic printer, controls the charging power supply to generate the charging voltage to obtain the charging current as the surface potential of the photosensitive drum, obtains the transfer current detected by the transfer current detection unit, obtains another transfer current at the transfer voltage at several points from the transfer current detection unit in a state when the discharge unit is turned on, calculates the charging current needed in obtaining the obtained transfer current in the state when the discharge unit is turned on, and stores the calculated charging voltage in the memory unit.

BRIEF DESCRIPTION OF THE DRAWINGS

These and other objects and advantageous of the invention will become apparent and more readily appreciated from the following description of the preferred embodiments, taken in conjunction with the accompanying drawings of which:

FIG. 1 is a table showing characteristics of a photosensitive layer corresponding to a surface of a photosensitive drum according to photosensitive layer wear;

DETAILED DESCRIPTION OF THE PREFERRED EMBODIMENTS

Figure 2:
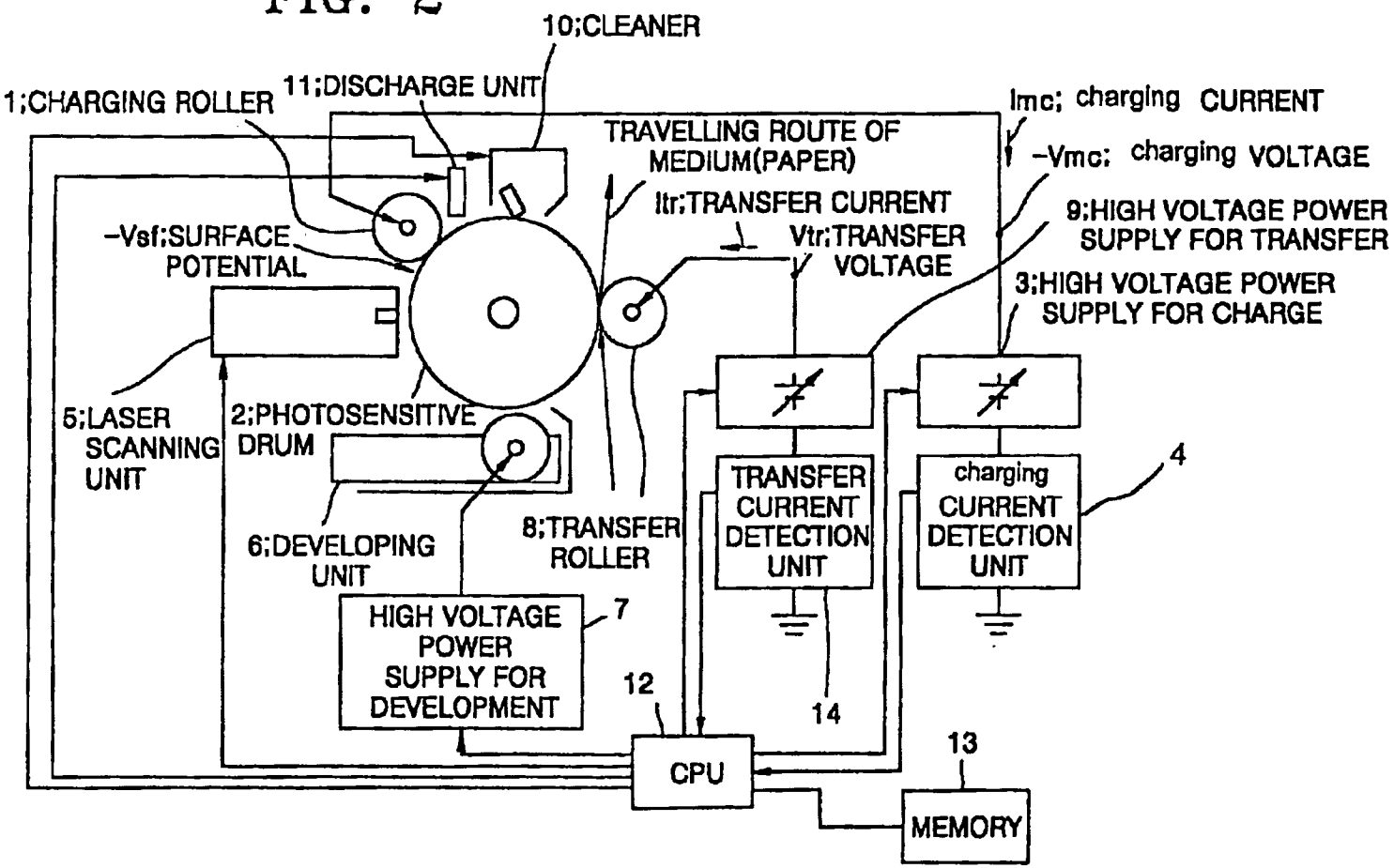
FIG. 2 illustrates a structure of an electrophotographic printer according to an embodiment of the present invention.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

FIG. 2 illustrates a structure of an electrophotographic printer according to an embodiment of the present invention. A charging roller 1 charges a surface of a photosensitive drum 2 during an initial printing process. Accordingly, a charging high voltage power supply 3 which supplies an electric charge, that is, a charging current Imc, is connected to the charging roller 1, and a charging current detection unit 4 detecting the charging current Imc is connected between the charging high voltage power supply 3 and a ground potential. According to another embodiment of the present invention, the charging current detection unit 4 may be connected between the charging roller 1 and the charging high voltage power supply 3.

A laser scanning unit (LSU) 5 radiates a laser beam corresponding to an image onto the charged surface of the charged photosensitive drum 2 to partially reduce a surface potential of the charged surface of the photosensitive drum 2, thereby forming an electrostatic latent image according to a local potential difference on the surface of the photosensitive drum 2. A developing unit 6 adsorbs charged toner in a portion of the surface of the photosensitive drum 2 onto which the laser beam is radiated, through the electrical charge supplied from a developing high voltage power supply 7. That is, since there is no electrical charge in the portion on which the laser beam is radiated, repulsion between the charged toner and the portion does not occur, and thus the charged toner is adsorbed in the portion. By locally adsorbing the charged toner, a toner image is formed on the surface of the photosensitive drum 2.

A transfer roller 8 transfers the toner image formed on the surface of the photosensitive drum 2 onto paper, e.g., a printing medium. Thus, the transfer roller 8 is connected to a transfer high voltage power supply 9 which generates a transfer voltage Vtr, and thus attaches the charged toner onto the paper from the surface of the photosensitive drum 2 by the transfer voltage Vtr. A transfer current detection unit 14 is connected between the transfer high voltage power supply 9 and the ground potential to detect a transfer current Itr. In addition, the transfer current detection unit 14 may be connected between the transfer roller 8 and the transfer high voltage power supply 9.

A cleaner 10 removes residual toner remaining on the surface of the photosensitive drum 2 after the charged toner is transferred, and a discharge unit 11 removes the electrical charge on the surface of the photosensitive drum 2.

A CPU (arithmetic and control unit) 12 controls the charging high voltage power supply 3, the LSU 5, the developing high voltage power supply 7, the transfer high voltage power supply 9, the cleaner 10, and the discharge unit 11. In addition, a memory (memory unit) 13 is connected to the CPU 12.

A charging voltage −Vmc as an output voltage of the charging high voltage power supply 3, and the transfer voltage Vtr as an output voltage of the transfer high voltage power supply 9 may vary by a command from the CPU 12. The CPU 12 performs an arithmetic operation, which will be described later, according to the charging current Imc detected by the charging current detection unit 4 and the transfer current Itr detected by the transfer current detection unit 14 and controls the charging high voltage power supply 3 to change (adjust) the charging voltage −Vmc. As the charging voltage −Vmc is changed, the charging current Imc varies. In addition, although not shown, the CPU 12 controls on and off of a rotation of the photosensitive drum 2.

Figure 3:
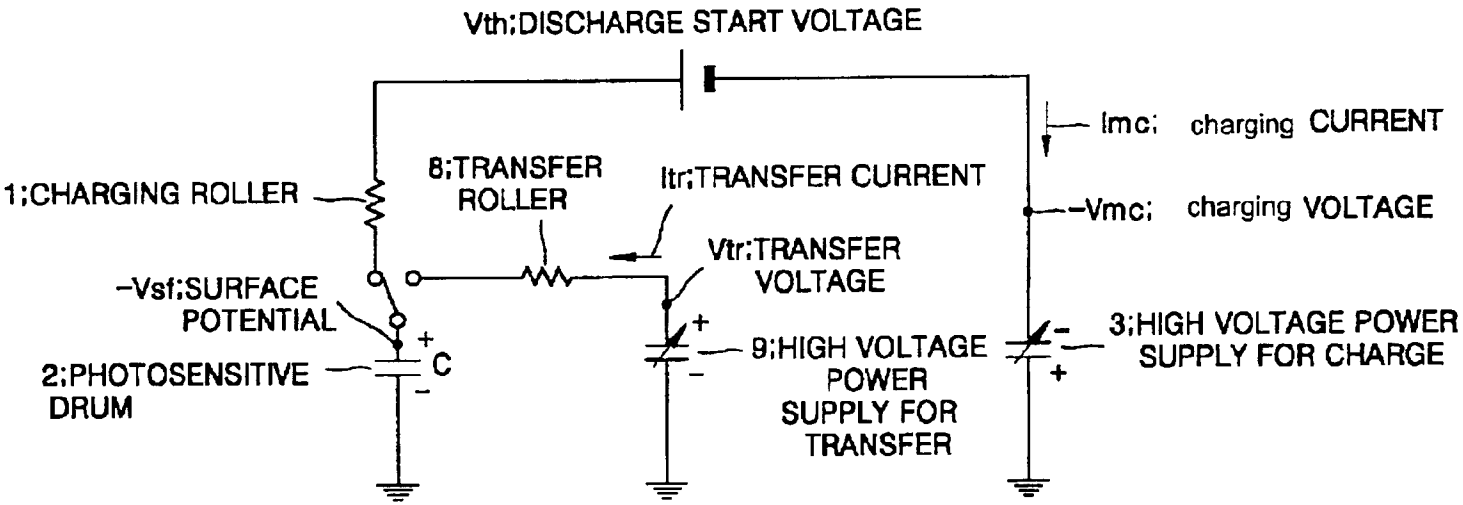
FIG. 3 is a circuit diagram equivalent to a system for generating a charging current and a transfer current in the electrophotographic printer as shown in FIG. 2.

FIG. 3 is a circuit diagram equivalent to a system for generating the charging current Imc and the transfer current Itr. The charging roller 1 is substituted with a resistor R, the photosensitive drum 2 is substituted with a capacitor C, and the transfer roller 8 is substituted with a resistor R2.

An initial operation performed during warming up after a power supply of the electrophotographic printer is turned on, will be described with reference to FIGS. 2 and 3. In addition, it is assumed that the photosensitive drum 2 rotates continuously. First, the discharge unit 11 of FIG. 2 is turned on by the command from the CPU 12, and thus the electrical charge on the surface of the photosensitive drum 2 is removed. The removing of the electrical charge means in FIG. 3 that the electrical charge charged to the capacitor C representing the photosensitive drum 2 is discharged and thus becomes a zero state.

Next, the discharge unit 11 is turned off, the electrical charge is transmitted to the surface of the photosensitive drum 2 from the charging high voltage power supply 3 through the charging roller 1, and the surface of the photosensitive drum 2 is charged. That is, the charging current Imc flows through the surface of the photosensitive drum 2 through the charging high voltage power supply 3 which generates the charging voltage −Vmc. In this case, the charging voltage −Vmc is set to a target value of a surface potential −Vsf of the photosensitive drum 2.

If the surface of the photosensitive drum 2 is charged (if the capacitor C is charged), the surface potential −Vsf of the photosensitive drum 2 is near −(Vmc−Vth), and the charging current Imc is reduced. Here, Vth is a discharge start voltage. In addition, in the equivalent circuit diagram of FIG. 3, the charging current Imc is not a consecutive (continuous) value but an intermittent value since the capacitor C represents the photosensitive drum 2 rotating such that the photosensitive drum 2 (C) repeatedly performs charging and discharging functions. Accordingly, in an real machine employing the system, the charging current Imc appears as the consecutive value. However, in the present description, the charging current Imc will be described on the basis of the circuit diagram of FIG. 3. That is, the surface potential −Vsf of the photosensitive drum 2 is equal to −(Vmc−Vth), and the charging current Imc is in a zero state. In this case, the transfer voltage Vtr is fixed at a predetermined value, and the transfer current Itr is detected.

In addition, in the real machine, the charging roller 1 and the transfer roller 8 are not installed in the same position on the photosensitive drum 2. In an example shown in FIG. 2, the charging roller 1 is arranged on a left top side of the photosensitive drum 2, and the transfer roller 8 is arranged on a right side of the photosensitive drum 2. That is, the capacitor C disposed on one position of the surface of the photosensitive drum 2 is not simultaneously connected to both the charging roller 1 and the transfer roller 8, but is connected to the charging roller 1 and then is connected to the transfer roller 8 if the photosensitive drum 2 rotates at a predetermined angle. In order to explain this phenomenon, an imaginary switch SW is added to FIG. 3.

Figure 4:
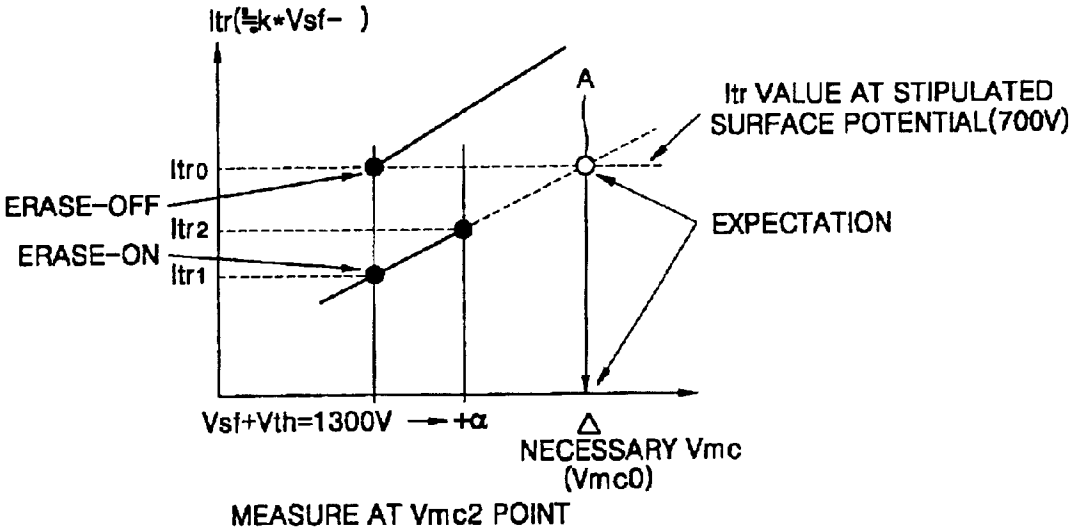
FIG. 4 is a graph illustrating operation of the system as shown in FIG. 3 in the electrophotographic printer as shown in FIG. 2.

FIG. 4 is a graph illustrating an operation of the circuit diagram and the system of the electrophotographic printer shown in FIGS. 2 and 3, respectively. The transfer current measured during the initial operation is indicated as Itr0. Subsequently, the discharge unit 11 is turned on (erase-on), and thus the transfer current Itr is detected when the charging voltage −Vmc is not changed. In this case, the detected transfer current is indicated as Itr1. As the discharge unit 11 is turned on, the surface of the photosensitive drum 2 is discharged whenever the photosensitive drum 2 makes one revolution, and thus the charging current Imc flows through the charging roller 1 (resistor R). An absolute value of the surface potential is reduced to a voltage drop in the charging roller 1 (resistor R). Then, the transfer current is reduced. As such, the transfer current Itr1 when the discharge unit 11 is turned on, is smaller than the transfer current Itr0 when the discharge unit 11 is turned off (erase-off).

In addition, the charging voltage −Vmc is changed and becomes −(Vmc+α), and the transfer current Itr is detected in the state when the discharge unit 11 is turned on. In this case, the detected transfer current is indicated as "Itr2". That is, the transfer current Itr is detected at two points in the state when the discharge unit 11 is turned on. The charging voltage −Vmc0 at point A, in which a straight line passing through the two points intersects with a line representing Itr=Itr0, is calculated by the CPU 12, and the calculated charging voltage is stored in the memory (memory unit) 13.

In a printing procedure, the calculated charging voltage −Vmc0 stored in the memory (memory unit) 13 in the initial operation is used as the charging voltage supplied to the photosensitive drum 2 through the charging roller 1 during a next revolution of the photosensitive drum 2. While the photosensitive drum 2 makes one revolution by the charging voltage −Vmc0, the surface potential of the photosensitive drum 2 becomes a desired potential.

As described above, according to the present invention, the surface potential of the photosensitive drum can be maintained at a desired constant value without using a high-priced surface potential sensor. As such, the surface potential of the photosensitive drum can be maintained at a constant value without increasing costs. In particular, even when the surface of the photosensitive drum wears down, the surface potential of the photosensitive drum can be maintained constant during a life span of the photosensitive drum. As a result, the electrophotographic printer, which can maintain a quality of a printed picture constant during the life span of the photosensitive drum, can be achieved.

While this invention has been particularly shown and described with reference to preferred embodiments thereof, it will be understood by those skilled in the art that various changes in form and details may be made therein without departing from the spirit and scope of the invention as defined by the appended claims and equivalents thereof.

What is claimed is:

1. An electrophotographic printer comprising:

a charging power supply which generates a first variable charging voltage;

a charging roller to which the charging voltage generated by the charging power supply is supplied;

a photosensitive drum charged by the charging roller;

a discharge unit which discharges the charged photosensitive drum;

a charging current detection unit which detects a charging current flowing between the charging power supply and the charging roller;

a transfer power supply which generates a predetermined transfer voltage;

a transfer roller to which the transfer voltage generated by the transfer power supply is supplied;

a transfer current detection unit which detects a first transfer current flowing between the transfer power supply and the transfer roller;

an arithmetic and control unit which controls the first variable charging voltage generated by the charging power supply, on and off of a rotation of the photosensitive drum, and on and off of the discharge unit and receives the charging value of the charging current detected by the charging current detection unit and the transfer value of the first transfer current detected by the transfer current detection unit; and a memory unit connected to the arithmetic and control unit;

wherein the arithmetic and control unit controls the photosensitive drum to make a plurality of revolutions in a state when the discharge unit is turned off in an initial operation of the electrophotographic printer, controls the charging power supply to generate the charging voltage to obtain the charging current as a surface potential of the photosensitive drum, obtains a second transfer current detected by the transfer current detection unit in a state when the discharge unit is turned on, calculates the charging voltage needed to obtain, from the second transfer current, the first transfer current in the state when the discharge unit is turned on and stores the calculated charging voltage in the memory unit, and in a printing procedure, the arithmetic and control unit rotates the photosensitive drum in the state when the discharge unit is turned on, and equalizes the charging voltage output from the charging power supply to the calculated charging voltage stored in the memory unit.

2. The printer of claim 1, wherein the arithmetic and control unit obtains a third transfer current corresponding to the first charging voltage from the transfer current detection unit in the state when the discharge unit is turned on, calculates the charging voltage needed to obtain, from the second and third transfer currents, the first transfer current in the state when the discharge unit is turned on, and stores the calculated charging voltage in the memory unit.

3. An electrophotographic printer comprising:

a charging power supply which generates a first variable charging voltage;

a charging roller to which the charging voltage generated by the charging power supply is supplied;

a photosensitive drum charged by the charging roller;

a discharge unit which discharges the charged photosensitive drum;

a charging current detection unit which detects a charging current corresponding to a surface potential of the charged photosensitive drum;

a transfer power supply which generates a transfer voltage in response to the first variable charging voltage;

a transfer roller supplied with the transfer voltage generated by the transfer power supply to transfer an image from the photosensitive drum to a recording medium;

a transfer current detection unit which detects a first transfer current of the transfer power supply when the discharge unit is on, and a second transfer current of the transfer power supply when the discharge unit is off; and an arithmetic and control unit controlling the charging power supply to generate a second charging voltage in response to the first transfer current and the second transfer current.

4. The printer of claim 3, wherein the transfer current detection unit detects a third transfer current, and the arithmetic and control unit controls the charging power supply to generate the second charging voltage in response to the second transfer current and the third transfer current.

5. The printer of claim 4, wherein the third transfer cu rent is detected when the discharge unit is on.

6. The printer of claim 5, wherein the arithmetic and control unit calculates the second charging voltage corresponding to an intersection between a first line passing through the first transfer current and a second line passing through the second transfer current and the third transfer current when the first transfer current, the second transfer current and the third transfer current are indicated in a voltage-current graph.

7. The printer of claim 3, wherein the second charging voltage is supplied to the charging roller when the discharge unit is on.

8. The printer of claim 3, wherein the charging current detection unit is connected between the charging power supply and the charging roller.

9. The printer of claim 3, wherein the charging current detection unit is connected between the charging power supply and a voltage potential.

10. The printer of claim 3, wherein the transfer current detection unit is connected between the transfer power supply and the transfer roller.

11. The printer of claim 3, wherein the transfer current detection unit is connected between the transfer power supply and a potential.

12. The printer of claim 3, wherein the charging current is maintained at a level when the first charging voltage and the second charge voltage are supplied to the charging roller.

13. The printer of claim 3, wherein the charging voltage is supplied to the charging roller when the discharge unit is off, and the second charging voltage is supplied to the charging roller when the discharge unit is on.

14. The printer of claim 3, further comprising:

a memory storing the first transfer current, the second transfer current, and the second charging voltage.

15. The printer of claim 3, wherein the discharge unit discharges the photosensitive drum when the discharge unit is on, and the discharge unit does not discharge the photosensitive drum when the discharge unit is off.

16. An electrophotographic printer comprising:

a power supply generating a charging voltage and a transfer voltage;

a charging roller supplied with the charging voltage;

a photosensitive drum charged by the charging roller;

a discharge unit discharging the charged photosensitive drum in an on-state;

a charging current detection unit which detects a charging current flowing to the charging roller to charge the photosensitive drum;

a transfer roller supplied with the transfer voltage generated by a transfer power supply to transfer an image from the photosensitive drum to a recording medium;

a transfer current detection unit detecting a transfer current of the transfer power supply; and an arithmetic and control unit controlling on and off of a rotation of the photosensitive drum, on and off of the discharge unit, and controlling the power supply to generate a second charging voltage to the charging roller to charge the photosensitive in response to the transfer current and the on and off of the discharge unit.

17. The printer of claim 16, wherein the transfer current comprises a first transfer current detected when the discharge unit is off, and a second transfer current detected when the discharge unit is on, and the arithmetic and the control unit calculates the second charging voltage from the first transfer current and the second transfer current.

18. A method in an electrophotographic printer having a scanning unit, the method comprising:

detecting a charging current flowing from a charging power supply to a charging roller charging a photosensitive drum to be scanned by the scanning unit after being charged by the charging roller;

detecting a transfer current flowing from a transfer power supply to a transfer roller transferring an image on a recording medium from the photosensitive drum; and controlling a charging power supply to change the charging voltage in response to the transfer current to maintain the charging current at a level.

19. A method an electrophotographic printer having a scanning unit, the method comprising:

detecting a charging current flowing from a charging power supply to a charging roller charging a photosensitive drum to be scanned by the scanning unit after being charged by the charging roller;

detecting a transfer current flowing from a transfer power supply to a transfer roller transferring and fixing an image on a recording medium from the photosensitive drum; and controlling the charging power supply to change the charging voltage in response to the transfer current to maintain the charging current at a level, wherein the printer comprises a discharge unit discharging the photosensitive drum in an on state, and wherein the detecting of the transfer current includes detecting a first transfer current flowing from the transfer power supply to the transfer roller when the discharge unit is in the on state and detecting a second transfer current flowing from the transfer power supply to the transfer roller when the discharge unit is not in the on state.

20. The method of claim 19, wherein the controlling oft charging power supply comprises:

generating a second charging voltage in response to the first transfer current and the second transfer current; and controlling the charging power supply to generate the second charging voltage as the charging voltage.

21. The method of claim 20, wherein the detecting of the transfer current and the controlling of the charging power supply comprise:

detecting a third transfer current flowing from the transfer power supply to the transfer roller when the discharge unit is not in the on state; and generating the second charging voltage in response to the third transfer current.

22. A method in an electrophotographic printer having a scanning unit, the method comprising:

detecting a charging current flowing from a charging power supply to a charging roller charging a photosensitive drum to be scanned by the scanning unit after being charged by the charging roller;

detecting a transfer current flowing from a transfer power supply to a transfer roller transferring and fixing an image on a recording medium from the photosensitive drum; and controlling the charging power supply to change the charging voltage in response to the transfer current to maintain the charging current at a level, wherein the detecting of the transfer current comprises: detecting an on and off state of the discharge unit; and detecting the transfer current during one of the on and off state of the discharge unit.

* * * * *

UNITED STATES PATENT AND TRADEMARK OFFICE

CERTIFICATE OF CORRECTION

PATENT NO. : 6,782,215 B2
DATED : August 24, 2004
INVENTOR(S) : Tomohiro Komori

It is certified that error appears in the above-identified patent and that said Letters Patent is hereby corrected as shown below:

Column 6,
Line 57, change “cu rent” to -- current --.

Column 8,
Line 4, after “A method,” insert -- in --.
Line 26, change “oft” to -- of the --.

Signed and Sealed this

First Day of March, 2005

JON W. DUDAS
*Director of the United States Patent and Trademark Office*